United States Patent [19]

Mayer et al.

[11] Patent Number: 4,932,679

[45] Date of Patent: Jun. 12, 1990

[54] CHILDREN'S BOOKS

[75] Inventors: Andrew S. Mayer; James F. Becker, both of Santa Monica; Richard H. Witt, Long Beach, all of Calif.

[73] Assignee: Becker-Mayer Associates, Santa Monica, Calif.

[21] Appl. No.: 367,199

[22] Filed: Jun. 16, 1989

[51] Int. Cl.[5] ..... B42D 5/00

[52] U.S. Cl. ..... 281/18; 281/2; 281/5; 281/16; 281/23; 281/51; 283/62

[58] Field of Search ..... 281/16, 23, 51, 29, 281/30, 31, 2, 5, 18; 402/75; 283/62

[56] References Cited

U.S. PATENT DOCUMENTS

| | | | |
|---|---|---|---|
| 1,199,761 | 10/1916 | Chase | 283/62 |
| 1,363,081 | 12/1920 | Brown | 283/62 |
| 1,913,818 | 6/1933 | Petrick | 281/16 |
| 2,458,729 | 1/1949 | Politzer | 281/5 |
| 3,414,296 | 12/1968 | Schneider | 281/29 |
| 3,738,686 | 6/1973 | Morse | 281/33 |
| 4,487,590 | 12/1984 | Becker et al. | 446/71 |
| 4,490,123 | 12/1984 | Becker et al. | 446/204 |
| 4,597,743 | 7/1986 | Becker et al. | 446/147 |
| 4,620,725 | 11/1986 | Maehashi | 281/31 |
| 4,630,843 | 12/1986 | Willat | 281/30 |

FOREIGN PATENT DOCUMENTS

| | | | |
|---|---|---|---|
| 1326572 | 4/1963 | France | 281/16 |

*Primary Examiner*—Douglas D. Watts
*Assistant Examiner*—Thomas Hamill, Jr.
*Attorney, Agent, or Firm*—Knobbe, Martens, Olson & Bear

[57] ABSTRACT

A book having two bindings with multiple pages and two covers comprises a single sheet which is folded in an accordion fashion. The bindings are located at the leftmost and rightmost sides of the book while fasteners associated with each binding allow the book to be opened from either side.

8 Claims, 1 Drawing Sheet

CHILDREN'S BOOKS

Background

The present invention relates to children's books and particularly to children's books having entertainment features.

It is sometimes difficult to interest young children in reading books. The prior art has addressed this problem by designing children's books so that they are visually attractive and have eye-catching features. While visual attraction may be sufficient to initially interest the child, there exists a need for a book which incorporates innovative structural features that maintain the child's interest over a long period of time.

Summary of the Invention

The book of the present invention comprises a series of interconnected sheets attached to one another so as to permit the sheets to be folded in accordion fashion to form the pages of the book. A first binding of the book binds the sheets along one side, thereby permitting the book to be opened to a first set of pages. Similarly, a second binding of the book binds the sheets along another side, thereby permitting the book to be opened to a second set of pages. Fasteners are preferably included on the bindings to detachably fasten the outermost of the series sheets together, such that the interior sheets are retained between two outer sheets without affixation to the bindings.

In the preferred embodiment, the multiple sheets of the book are formed from a single piece of material which comprises cardboard. The first set of pages are on one side of the single piece of material, and the second set of pages are on the opposite side of the same piece of material.

Description of the Drawings

These and other features of the present invention may be more fully understood through reference to the drawings in which.

Description of the Preferred Embodiment

Figure 3:
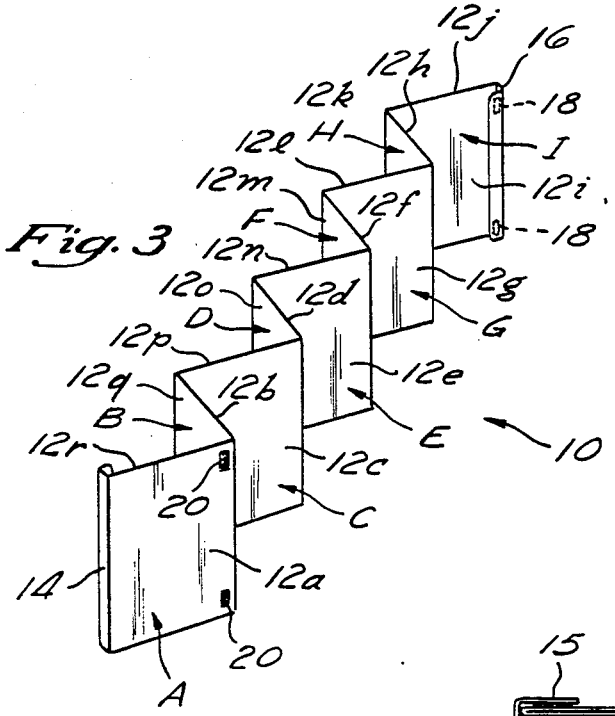
FIG. 3 is a perspective view of the book with both bindings unfastened showing the manner in which the interior pages, covers and bindings are integrally formed from a single piece of material and showing the accordion fold which forms the pages.
Figure 4:
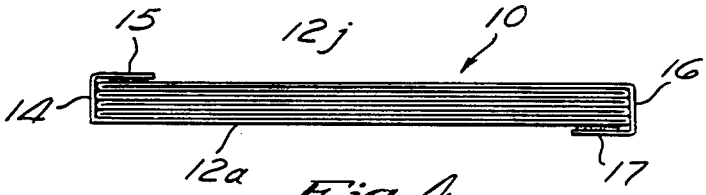
FIG. 4 is a plan view of the book which further illustrates the accordion fold and bindings.

As shown in FIGS. 1, 2, 3 and 4, the book 10 of the present invention comprises two bindings, either of which may be opened or closed to expose interior pages 12*b–i* or 12*k–r*, respectively. Interior pages 12*b–i* correspond to a first story, referred to herein as "Story One" and interior pages 12*k–r* correspond to a second story, referred to herein as "Story Two." A cover page 12*a* is included for Story One and a cover page 12*j* is included for Story Two. As best seen in FIG. 3, the pages 12*a–i* and 12*j–r* are disposed on opposite sides of a single piece of material (such as 1/32-inch cardboard) having a rectangular configuration with a length significantly greater than its width. The material is folded in accordion fashion to form a series of interconnected sheets A–I. Each sheet A–I corresponds to a pair of pages 12, one from Story One and the other from Story Two. For example, sheet A has the cover page 12*a* of Story One on one side and the last page of Story Two on the other side. Sheet B has the first page of Story One on one side and the second last page of Story Two on the other. The sheets A–I are generally rectangular, each having four marginal edges with two of the edges forming the sides of the book 10, and the other two edges forming the bottom and top, respectively, of the book 10. In the embodiment shown, the sheets A–I of the book 10 are identical in size. By way of specific example, the sheets A–I may be about 7–¾ inches in height by 6–¾ inches in width.

Figure 1:
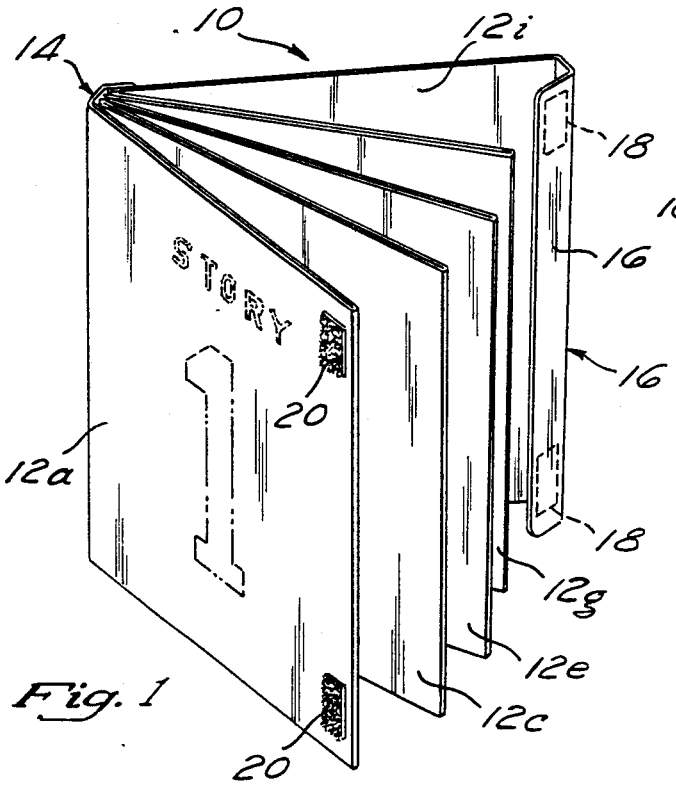
FIG. 1 is a perspective view of the book of the present invention, showing the book in an open condition with one of the two bindings unfastened for exposing the interior pages of Story One for reading.
Figure 2:
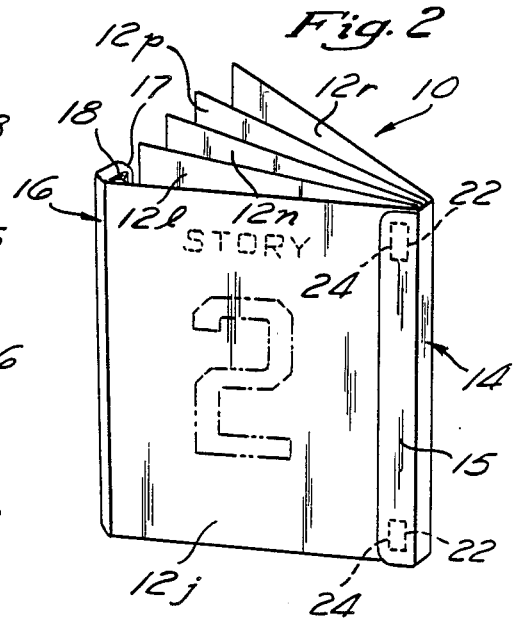
FIG. 2 is a perspective view showing the book of FIG. 1 from the opposite side.
Figure 5:
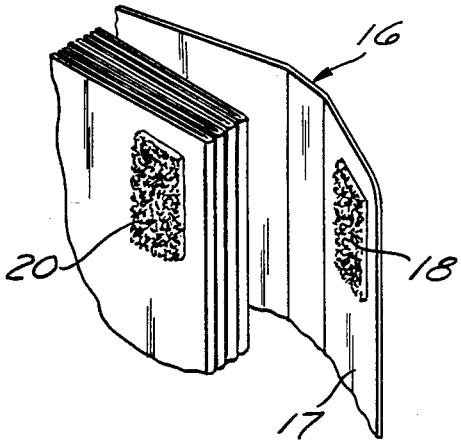
FIG. 5 is an enlarged view showing one of the velcro fasteners on one of the bindings.

The bindings of the book 10 are identical in structure. The two bindings comprise flaps 14 and 16, respectively, which are integral with the two outermost sheets A and I of the accordion folded sheets A–I. The flaps 14 and 16 extend from the ends of the sheets A and I, respectively, and are formed by two creases or folds which are parallel to the accordion folds of the sheets A–I. The distance between these creases is approximately equal to the combined thickness of the sheets A–I, so that when the book 10 is in a closed condition, the flaps 14 and 16 wrap around the sides of the book 10, with flap portions 15 and 17 in contact with the cover pages 12*j*, 12*a*, respectively, of the outermost sheets I and A, respectively. The bindings are held in place by mating strips of velcro, as illustrated in FIG. 5. More specifically, the flap portion 17 includes a pair of velcro strips 18 at opposite ends of the flap portion 17 which mate with corresponding velcro strips 20 on the cover page 12*a*. Similarly, the flap portion 15 includes a pair of velcro strips 22 which mate with corresponding velcro strips 24 on the cover page 12*j*. The velcro strips provide detachable fasteners for the bindings so that each of the bindings may be selectively opened or closed by detaching or attaching the velcro strips.

In order to open the binding to read Story One, a child would typically hold the flap 14 in his left hand while placing the thumb of his right hand between the cover page 12*a* and the interior side of the flap 16. By prying the interior side to break the adhesion between the velcro fasteners 18, 20, the binding may be opened, thereby exposing pages 12*b–i* of Story One. When the child finishes reading Story One, the binding may be closed by pressing the velcro fasteners 18,20 against each other.

Story Two is read by detaching the other binding. A child would hold the flap 16 in his left hand while placing the thumb of his right hand between the cover page 12*j* and the interior side of the flap 14, so as to pry away the interior side and thereby detach the two velcro fasteners 22, 24. When the child finishes reading Story Two, the binding may be reattached by pressing the velcro fasteners 22,24 against each other.

What is claimed is:

1. A book, comprising:

a series of interconnected sheets folded in accordion fashion to form pages of said book, said series of sheets having (i) two outer sheets which form first and second cover pages, and plural interior sheets which form first and second sets of interior pages between said cover pages, said first set of pages being on one side of said interconnected sheets and said second set of pages being on the opposite side of said interconnected sheets;

a first binding for said book which binds said outer sheets together along one side of said book to permit said book to be opened to said first set of pages; and a second binding for said book which binds said outer sheets together along another side of said book to permit said book to be opened to said second set of pages, each of said first and second bindings fastening the two outer sheets together such that the first binding is detachable without detaching the second binding, and the second binding is detachable without detaching the first binding.

2. A book as defined in claim 1 wherein the interconnected sheets are formed from a single piece of material.

3. A book as defined in claim 2 wherein said material comprises cardboard.

4. A book, as defined in claim 1, wherein each of said bindings detachably fastens the two outer sheets, such that the remainder of said series of sheets are retained between said outer sheets without affixation to said bindings.

5. A book, as defined in claim 1, wherein said outer sheets include velcro fasteners.

6. A book, as defined in claim 1, wherein at least one of the bindings comprises a flap extending from one of said sheets, said flap and said one of said sheets being formed from a single piece of material.

7. A book, comprising:

a series of interconnected sheets formed of a single piece of cardboard, said sheets folded in accordion fashion to form pages of said book, said series of sheets having (i) two outer sheets which form first and second cover pages and plural interior sheets which form first and second sets of interior pages between said cover pages, said first set of pages being on one side of said single piece of cardboard and said second pages being on the opposite side of said single piece of cardboard;

a first binding for said book which binds said outer sheets together along one side of said book to permit said book to be opened to said first set of interior pages, said first binding comprising a first flap extending from one of said outer sheets, said first flap having a velcro fastener thereon which mates with a corresponding velcro fastener on the other of said outer sheets, said first flap being formed of said single piece of cardboard; and a second binding for said book which binds said outer sheets together along the opposite side of said book to permit said book to be opened to said second set of interior pages, said second binding including a second flap extending from said other outer sheet, said second flap including a velcro fastener which mates with a corresponding velcro fastener on said one outer sheet, said second flap being formed of said single piece of cardboard, said sheets being identical and rectangular in size, each of said flaps being formed by two creases which are parallel to the accordion folds and separated by a distance which is approximately equal to the combined thickness of the accordion folded sheets so as to permit the flaps to wrap around the sides of the book with portions of the flaps against the cover pages of the outer sheets.

8. A book, comprising:

a series of interconnected sheets folded in accordion fashion to provide a first set of pages on one side of said interconnected sheets and a second set of pages on the opposite side of said interconnected sheets, said sheets having marginal edges which form edges of said book; and a first binding along one side of said book and a second binding along another side of said book, said bindings being selectably detachable such that (i) said first binding holds said interconnected sheets together along said one side of said book when said second binding is detached to permit said book to be opened to said second set of pages without exposing said first set of pages, and (ii) said second binding holds said interconnected sheets along said another side of said book when said first binding is detached to permit said book to be opened to said first set of pages without exposing said second set of pages.

* * * * *